US010386035B2

(12) United States Patent
Rabek et al.

(10) Patent No.: US 10,386,035 B2
(45) Date of Patent: Aug. 20, 2019

(54) LUMINAIRE FOR A MOTOR VEHICLE WITH OPTICAL WAVEGUIDE AND OPTICAL SHEET IN CONTACT WITH OPTICAL WAVEGUIDE AND DISPOSED AT AN ANGLE IN RELATION TO THE OPTICAL WAVEGUIDE

(71) Applicant: Dr. Ing. h.c. F. Porsche Aktiengesellschaft, Stuttgart (DE)

(72) Inventors: Alexander Rabek, Calw (DE); Heinz Redlich, Ludwigsburg (DE); Burkhard Leutiger, Pforzheim (DE); Ulrich Bauer, Gerlingen (DE); Malte Moessner, Stuttgart (DE)

(73) Assignee: DR. ING. H.C. F. PORSCHE AKTIENGESELLSCHAFT, Stuttgart (DE)

( * ) Notice: Subject to any disclaimer, the term of this patent is extended or adjusted under 35 U.S.C. 154(b) by 0 days.

(21) Appl. No.: 15/945,749

(22) Filed: Apr. 5, 2018

(65) Prior Publication Data

US 2018/0306399 A1 Oct. 25, 2018

(30) Foreign Application Priority Data

Apr. 21, 2017 (DE) ..... 10 2017 108 545

(51) Int. Cl.
*F21S 43/247* (2018.01)
*F21S 43/30* (2018.01)
(Continued)

(52) U.S. Cl.
CPC ..... *F21S 43/247* (2018.01); *F21S 43/239* (2018.01); *F21S 43/241* (2018.01); *F21S 43/245* (2018.01);
(Continued)

(58) Field of Classification Search
CPC .... B60Q 3/64; B60Q 3/62; B60Q 3/66; F21S 43/235; F21S 43/236; F21S 43/237;
(Continued)

(56) References Cited

U.S. PATENT DOCUMENTS 5,634,708 A * 6/1997 Koie ..... B60Q 1/302 362/503
5,772,304 A 6/1998 Smith
(Continued)

FOREIGN PATENT DOCUMENTS

DE 20205107 U1 8/2002
DE 10207694 A1 11/2003
(Continued)

*Primary Examiner* — Robert J May
(74) *Attorney, Agent, or Firm* — Leydig, Voit & Mayer, Ltd.

(57) ABSTRACT

A luminaire for a motor vehicle bodywork includes a light source configured to generate light beams, an optical waveguide configured to forward the light beams, and an optical sheet configured to emit the light beams. The optical sheet is arranged at an angle (γ), which is greater than 0°, with respect to the optical waveguide. A contact is formed between the optical waveguide and the optical sheet. The optical waveguide is configured to transfer the light beams onto the optical sheet. The light beams are guided into the optical sheet with the aid of at least one light guiding element via the contact.

19 Claims, 3 Drawing Sheets

(51) Int. Cl.

| | |
|---|---|
| ***F21S 43/239*** | (2018.01) |
| ***F21S 43/241*** | (2018.01) |
| ***F21S 43/245*** | (2018.01) |
| ***F21S 43/249*** | (2018.01) |
| ***F21S 43/31*** | (2018.01) |
| ***F21S 43/40*** | (2018.01) |
| *F21W 103/35* | (2018.01) |

(52) U.S. Cl.
CPC ..... *F21S 43/249* (2018.01); *F21S 43/30* (2018.01); *F21S 43/315* (2018.01); *F21S 43/40* (2018.01); *F21W 2103/35* (2018.01)

(58) Field of Classification Search
CPC ..... F21S 43/241; F21S 43/249; F21S 43/247; F21S 43/251
See application file for complete search history.

(56) References Cited

U.S. PATENT DOCUMENTS

| | | | | |
|---|---|---|---|---|
| 5,890,796 | A | 4/1999 | Marinelli et al. | |
| 6,974,238 | B2 * | 12/2005 | Sturt | B60R 13/02 257/89 |
| 7,938,566 | B2 * | 5/2011 | Ishida | B60Q 3/64 362/471 |
| 2012/0314448 | A1 * | 12/2012 | Nakada | F21S 43/247 362/602 |

FOREIGN PATENT DOCUMENTS

| | | | |
|---|---|---|---|
| DE | 19756596 | B4 | 3/2007 |
| EP | 0940625 | B1 | 3/2007 |

* cited by examiner

LUMINAIRE FOR A MOTOR VEHICLE WITH OPTICAL WAVEGUIDE AND OPTICAL SHEET IN CONTACT WITH OPTICAL WAVEGUIDE AND DISPOSED AT AN ANGLE IN RELATION TO THE OPTICAL WAVEGUIDE

CROSS REFERENCE TO RELATED APPLICATIONS

This application claims benefit to German Patent Application No. DE 10 2017 108 545.9, filed Apr. 21, 2017, which is hereby incorporated by reference herein.

FIELD

The invention relates to a luminaire for a motor vehicle bodywork.

BACKGROUND

The patent specification EP 0 940 625 B1 discloses a luminaire, wherein light is coupled into a light sheet with the aid of an optical waveguide. Light is deflected by facet-like deflection surfaces provided at the optical waveguide. The optical waveguide and the light sheet are configured integrally. Luminaires that are similar in principle are disclosed by the patent specifications U.S. Pat. No. 5,772,304 A and DE 197 56 596 B4.

The published patent application DE 102 07 694 A1 reveals a luminaire that can be used as a brake luminaire or reading luminaire. The light is coupled into a light sheet with the aid of an optical waveguide, wherein the light sheet can likewise be a cover sheet of the luminaire. Structures with the aid of which the light beams are deflected by 90° are provided at the optical waveguide itself.

The utility model specification DE 202 05 107 U1 reveals the production of a strip-like design.

SUMMARY

In an embodiment, the present invention provides a luminaire for a motor vehicle bodywork. The luminaire includes: a light source configured to generate light beams; an optical waveguide configured to forward the light beams; and an optical sheet configured to emit the light beams. The optical sheet is arranged at an angle (γ), which is greater than 0°, with respect to the optical waveguide. A contact is formed between the optical waveguide and the optical sheet. The optical waveguide is configured to transfer the light beams onto the optical sheet. The light beams are guided into the optical sheet with the aid of at least one light guiding element via the contact.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
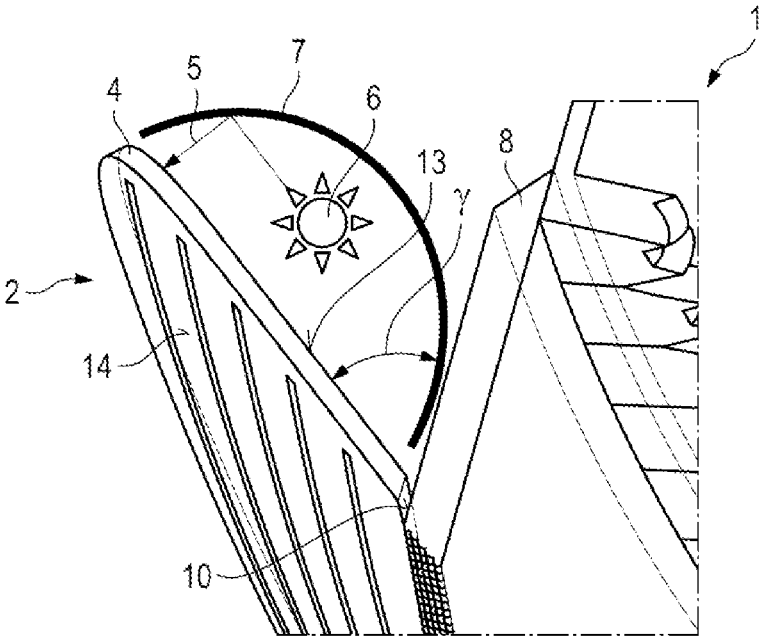
Fig. 1 (Prior Art)
FIG. 1 depicts a luminaire for a motor vehicle bodywork in accordance with the prior art in a semi-schematic, perspective excerpt illustration.

Embodiments of the present invention provide alternative luminaires for a motor vehicle bodywork.

A luminaire for a motor vehicle bodywork according to an embodiment of the invention includes a light source for generating light beams, an optical waveguide for forwarding the light beams, and an optical sheet for emitting light beams. The optical sheet is arranged at an angle, which is greater than 0°, with respect to the optical waveguide. A contact is formed between the optical waveguide and the optical sheet. The optical waveguide is configured for transferring light beams onto the optical sheet in a manner having at least one light guiding element, wherein the light beams are guided into the optical sheet with the aid of at least one light guiding element via the contact. On account of the light guiding or light feeding of the light beams via the optical waveguide into the optical sheet, both a light source required in the prior art and a reflector communicating with the light source can be obviated. The light is fed into the optical sheet in a targeted manner via the contact with the aid of the light guiding element. On account of the light guiding element, which is configured for aligning the light beam or light beams, the light beams can be guided into the optical sheet in a targeted manner, thereby avoiding a loss of radiation on account of the light beams not entering the optical sheet as a result of scattering. A highly efficient and cost-effective luminaire can thereby be formed.

In one configuration of a luminaire according to an embodiment of the invention, the optical waveguide includes a light guiding element exclusively in the region of the contact for the purpose of further cost-effective production. In this case, the light guiding element can be formed at the optical waveguide in a manner facing the contact or facing away from the contact. The light guiding element can be configured in such a way that it guides the light beams into the optical sheet in a targeted manner. Preferably, the light guiding element is configured in a prism-shaped fashion, wherein in principle it can also have other shapes suitable for guiding the light beams into the optical sheet in a targeted manner.

In a further configuration, the optical waveguide is provided in a disk-shaped fashion. Consequently, a contact of the size of the thickness of the optical sheet can be brought about and utilized effectively.

An integral configuration of the optical waveguide with the optical sheet leads to a cost-effective production and to the avoidance of leakiness of the luminaire in the region of the contact. This results in the realization of a luminaire protected against dirt and moisture in conjunction with cost-effective production on account of lower assembly costs. In this configuration, the contact is virtually present at that end of the optical sheet which faces the optical waveguide.

In a further configuration, in order to generate different brightnesses, or different light scatterings, the optical sheet has reflection elements. Depending on the reflection elements, it is possible to form e.g. totally light-nontransmissive sections of the optical sheet alongside light-transmissive sections of the sheet. The reflection elements can be present in the optical sheet, wherein, for cost-effective production, the optical sheet has the reflection elements as its first sheet surface and/or at its second sheet surface.

In order to provide a strip pattern, the reflection elements are configured in the form of grooves in a cost-effectively producible manner.

Figure 2:
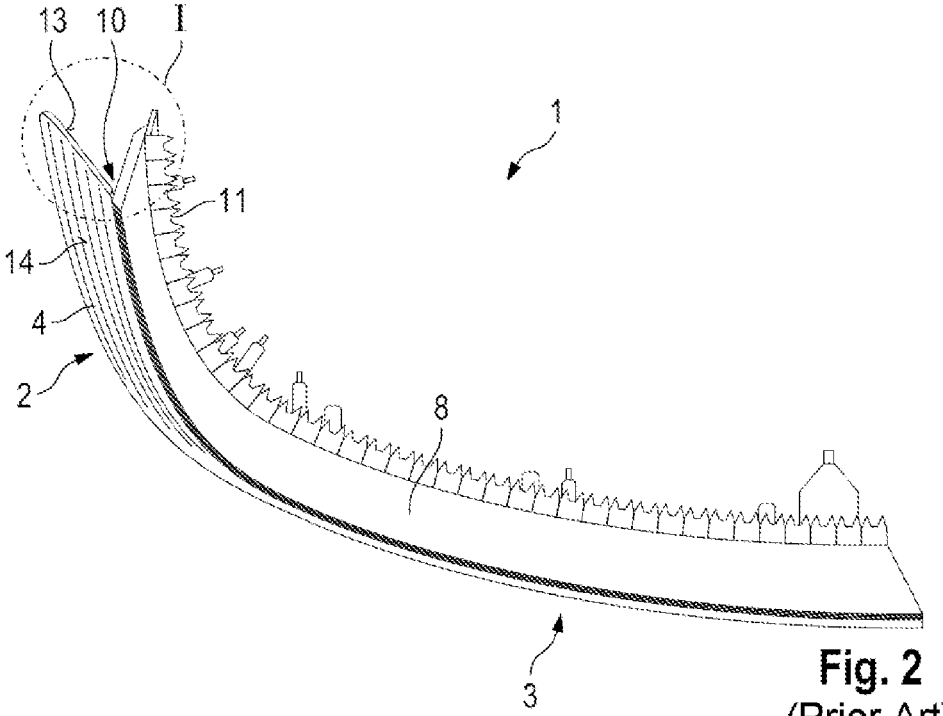
Fig. 2 (Prior Art)
FIG. 2 depicts the luminaire in accordance with FIG. 1 in a perspective plan view.

A luminaire 1 for a motor vehicle bodywork as configured in accordance with the prior art is depicted in FIG. 1. The luminaire 1, which is embodied by way of example as a rear luminaire, is configured in a curved fashion, in such a way that it is embodied in a manner bridging a transition between a transverse region and a longitudinal region of the motor vehicle bodywork, as is illustrated in FIG. 2. FIG. 1 illustrates that region of the luminaire 1 which is identified by I.

Luminaire 1 has a first part 2 and a second part 3, wherein the first part 2 is integratable into the longitudinal region of the motor vehicle bodywork and the second part 3 is integratable into the transverse region of the motor vehicle bodywork.

The luminaire 1 comprises an optical sheet 4, which is provided for emitting light beams 5. In order to produce a strip design in the first part of the luminaire 1, the light beams 5 in the first part 2 of the luminaire 1, proceeding from a light source 6, are directed with the aid of a reflector 7 onto the optical sheet 4, by which they are scattered.

The optical sheet 4 is preferably embodied integrally. That is to say that it is embodied in a manner extending over the first part 2 and the second part 3. It protects the interior of the luminaire 1 against weather influences, in particular against ingress of rainwater, dust and moisture. It is preferably embodied as pellucid and colorlessly transparent, but can also have set up in a manner integrated in it optical means such as lenses, roughened regions and prisms and likewise a coloration depending on requirements of the application, e.g. as rear luminaire a red coloration. Furthermore, as is known, said optical sheet is also used for design purposes.

In order to produce different scatterings, i.e. different optically perceptible light structures, as in the present exemplary embodiment of the strip-like design of the luminaire 1 in the first part 2, the optical sheet 4 is configured as light-transmissive and light-nontransmissive in sections. This varying light transmissivity can e.g. also be brought about with the aid of a link.

The luminaire 1 furthermore comprises an optical waveguide 8, which is configured for reflecting and forwarding light beams. In this exemplary embodiment, nondirectional light beams are parallelized with the aid of so-called collimators 11.

Figure 3:
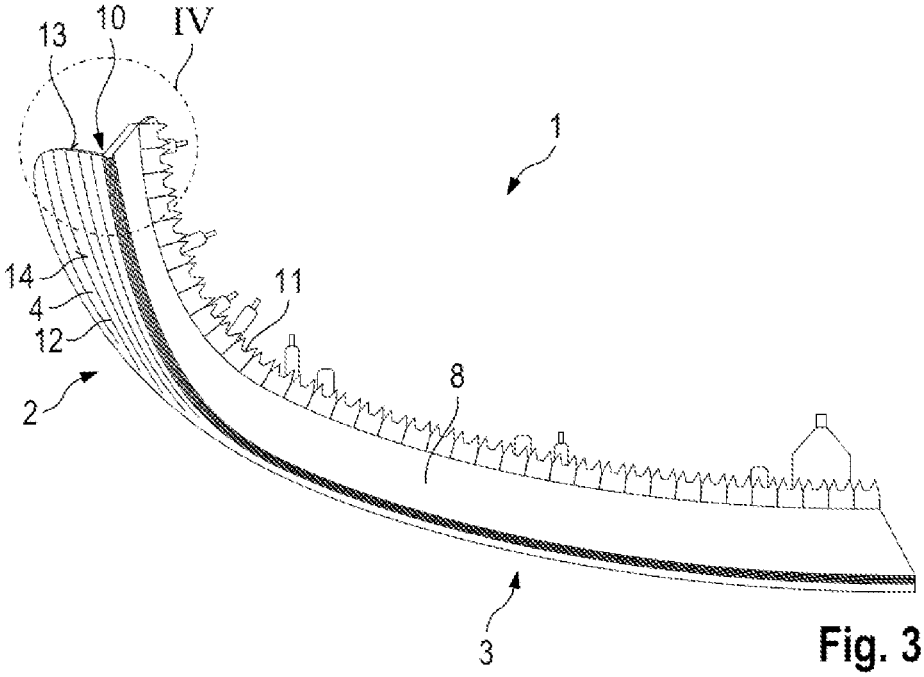
FIG. 3 depicts a luminaire for a motor vehicle bodywork according to an embodiment of the invention in a perspective plan view.
Figure 4:
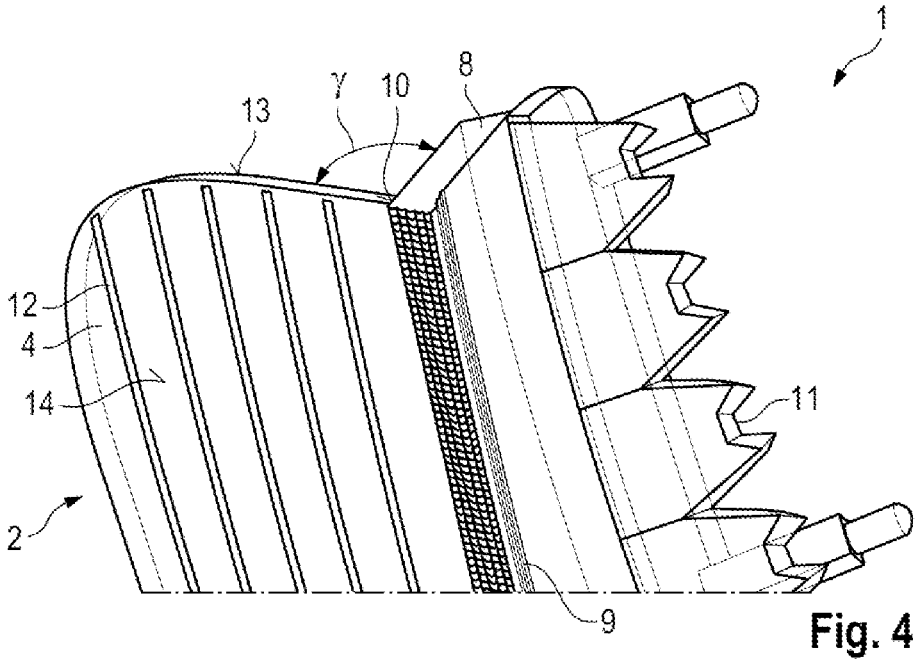
FIG. 4 depicts the luminaire in accordance with FIG. 3 in a perspective excerpt illustration.
Figure 5:
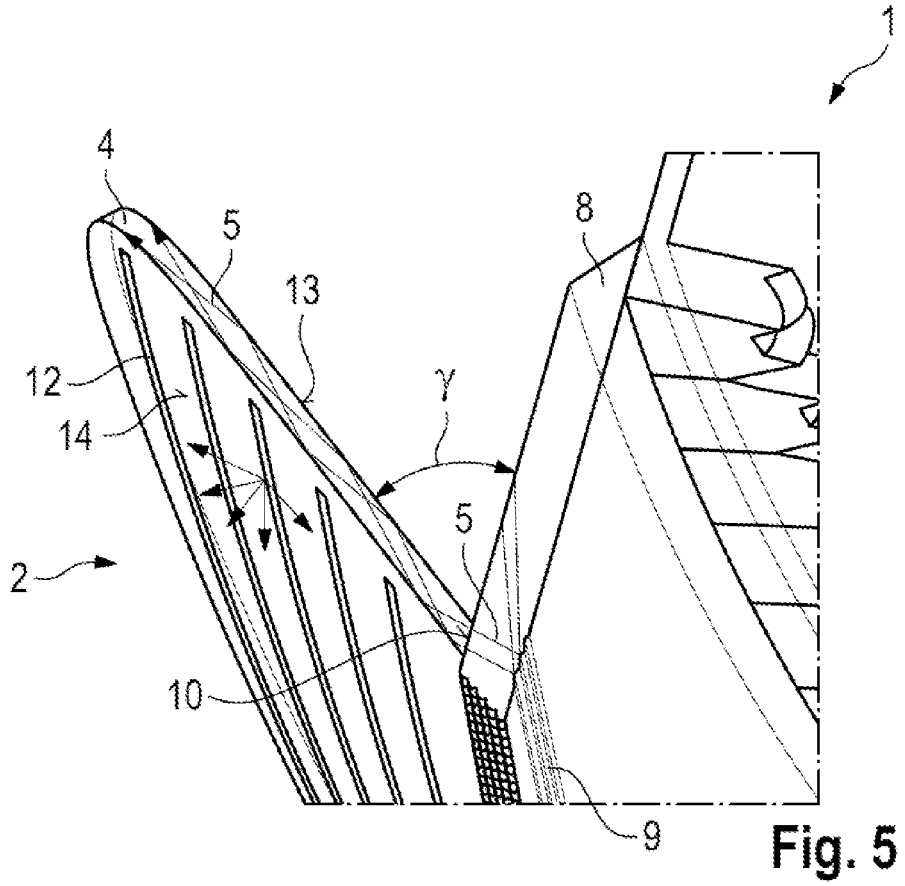
FIG. 5 depicts the luminaire in accordance with FIG. 3 in a further perspective excerpt illustration.

FIG. 3 illustrates a luminaire 1 according to an embodiment of the invention in a perspective plan view. For improved illustration of the invention, an excerpt IV from the luminaire is depicted in FIG. 4. Feeding-in of light for the light emission of the optical sheet 4 is brought about with the aid of the optical waveguide 8. That is to say, in other words, that a light source 6 in the region of the first part 2 can be obviated since the optical waveguide 8 is configured for feeding in light; consequently, light beams are transferred by the optical waveguide 8 onto the optical sheet 4.

For the reflection of the light beams 5, the optical waveguide 8 has light guiding elements 9, which are configured in the form of prisms in this exemplary embodiment. However, the light guiding elements 9 could also have any other shape suitable for deflecting the light beams 5. The light from the optical waveguide 8 is fanned out with the aid of the deflection elements 9.

The feeding-in of light, i.e. in other words the introduction of the light beams 5 proceeding from the optical waveguide 8, and the light emission are shown in FIG. 4, in which the luminaire 1 according to the invention is depicted in a further perspective excerpt illustration.

With the aid of the light guiding elements 9, which are preferably formed in the region of a contact area 10 present between the optical sheet 4 and the optical waveguide 8, the light is forwarded onto the optical sheet 4. The contact area 10, in order to bring about different brightnesses of the optical sheet 4, has said reflection elements 12. In the exemplary embodiment illustrated, the reflection elements 12 are configured in the form of grooves. They could likewise have any other shape suitable for bringing about different brightnesses. In this case, the reflection elements 12 can be arranged at a first sheet surface 13 of the optical sheet 4, said first sheet surface being formed in a manner facing the optical waveguide 8, and/or at a second sheet surface 14 of the optical sheet 4, said second sheet surface being formed in a manner facing away from the first sheet surface 13, and/or between the first sheet surface 13 and the second sheet surface 14 in the optical sheet 4.

Preferably, the optical waveguide 8 and the optical sheet 4 are combined in one component; in other words, the optical waveguide 8 and the optical sheet 4 are configured integrally.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A luminaire for a motor vehicle bodywork, the luminaire comprising:

a light source configured to generate light beams;

an optical waveguide configured to forward the light beams, the optical waveguide having first and second planar surfaces and an edge connecting the first planar surface to the second planar surface; and an optical sheet configured to emit the light beams, the optical sheet having first and second sheet surfaces and an edge connecting the first sheet surface to the second sheet surface, wherein the optical sheet is arranged at an angle (γ), which is greater than 0°, with respect to the optical waveguide, wherein a contact is formed between the optical waveguide and the optical sheet, the contact being formed by a portion of the edge of the optical sheet and a portion of the first planar surface of the optical waveguide, wherein the optical waveguide is configured to transfer the light beams into the optical sheet via the contact with the aid of at least one light guiding element, and wherein the at least one light guiding element is disposed on the second planar surface of the optical waveguide.

2. The luminaire as claimed in claim 1, wherein the optical waveguide includes the light guiding element exclusively in a region of the contact.

3. The luminaire as claimed in claim 1, wherein the light guiding element is configured in a prism-shaped fashion.

4. The luminaire as claimed in claim 1, wherein the optical waveguide is configured in a disk-shaped fashion.

5. The luminaire as claimed in claim 1, wherein the optical waveguide and the optical sheet are configured integrally with one another.

6. The luminaire as claimed in claim 1, wherein the optical sheet includes reflection elements in order to generate different brightnesses.

7. The luminaire as claimed in claim 6, wherein the reflection elements are disposed on the first sheet surface and/or the second sheet surface.

8. The luminaire as claimed in claim 6, wherein the reflection elements are configured in the form of grooves.

9. The luminaire as claimed in claim 1, wherein the luminaire is configured in the form of a rear luminaire.

10. The luminaire as claimed in claim 1, wherein the at least one light guiding element is disposed on a portion of the second planar surface of the optical waveguide, the portion of the second planar surface of the optical waveguide being parallel to the contact.

11. The luminaire as claimed in claim 10, wherein the portion of the second planar surface of the optical waveguide is located, relative to the contact, in a direction perpendicular to the portion of the first planar surface of the optical waveguide that forms the contact.

12. The luminaire as claimed in claim 10, wherein the luminaire is configured in a curved fashion and is configured to bridge a transition between a transverse region and a longitudinal region of the bodywork of the motor vehicle.

13. The luminaire as claimed in claim 12, wherein at a first end of the luminaire, the first and second sheet surfaces of the optical sheet extend in a direction substantially parallel to a transverse direction of the motor vehicle, and wherein at a second end of the luminaire, the first and second sheet surfaces of the optical sheet extend in a direction substantially parallel to a longitudinal direction of the motor vehicle.

14. The luminaire as claimed in claim 1, wherein the first and second planar surfaces of the optical waveguide are parallel.

15. The luminaire as claimed in claim 14, wherein the first and second sheet surfaces of the optical sheet are parallel.

16. The luminaire as claimed in claim 14, wherein the edge of the optical waveguide defines a width of the optical waveguide, the width of the optical waveguide being smaller than an extent of the optical waveguide along either of two perpendicular directions along which the first and second planar surfaces extend.

17. The luminaire as claimed in claim 16, wherein the edge of the optical sheet defines a width of the optical sheet, the width of the optical sheet being smaller than an extent of the optical sheet along either of two perpendicular directions along which the first and second sheet surfaces extend.

18. The luminaire as claimed in claim 1, wherein the luminaire is configured in a curved fashion and is configured to bridge a transition between a transverse region and a longitudinal region of the bodywork of the motor vehicle.

19. The luminaire as claimed in claim 18, wherein at a first end of the luminaire, the first and second sheet surfaces of the optical sheet extend in a direction substantially parallel to a transverse direction of the motor vehicle, and wherein at a second end of the luminaire, the first and second sheet surfaces of the optical sheet extend in a direction substantially parallel to a longitudinal direction of the motor vehicle.

* * * * *